US008332994B2

(12) United States Patent
Lin

(10) Patent No.: US 8,332,994 B2
(45) Date of Patent: Dec. 18, 2012

(54) SHOELACE WITH SHOELACE FASTENER

(76) Inventor: Jih-Liang Lin, Shoufeng Shiang (TW)

( * ) Notice: Subject to any disclaimer, the term of this patent is extended or adjusted under 35 U.S.C. 154(b) by 451 days.

(21) Appl. No.: 12/588,742

(22) Filed: Oct. 27, 2009

(65) Prior Publication Data

US 2011/0094072 A1 Apr. 28, 2011

(51) Int. Cl.
*A43C 7/04* (2006.01)

(52) U.S. Cl. ..... 24/712.6; 24/712.5

(58) Field of Classification Search ..... None
See application file for complete search history.

(56) References Cited

U.S. PATENT DOCUMENTS 1,279,043 A * 9/1918 Treadgold ..... 24/712.6
2,315,196 A * 3/1943 Gallione ..... 248/499
2,914,830 A * 12/1959 Peck ..... 24/712.6
3,057,029 A * 10/1962 Miller, Jr. et al. ..... 24/712.6
3,225,402 A * 12/1965 Altman et al. ..... 24/712.6
3,290,745 A * 12/1966 Maxwell et al. ..... 24/712.2
4,377,887 A * 3/1983 Valestin ..... 24/16 PB
4,574,434 A * 3/1986 Shupe et al. ..... 24/16 PB
4,882,813 A * 11/1989 Nakamura ..... 24/16 PB
5,097,573 A * 3/1992 Gimeno ..... 24/712.6
5,208,952 A * 5/1993 Mintel et al. ..... 24/588.11
5,467,508 A * 11/1995 Feng ..... 24/68 SK
5,572,778 A * 11/1996 Stenner et al. ..... 24/712.9
6,889,407 B2 * 5/2005 Martin ..... 24/136 R
7,458,134 B2 * 12/2008 Shiue ..... 24/68 E
7,571,520 B2 * 8/2009 Shiue ..... 24/265 BC
7,882,598 B2 * 2/2011 Coles et al. ..... 24/16 PB
2002/0189056 A1 * 12/2002 Gallina et al. ..... 24/68 R
2004/0148741 A1 * 8/2004 Hsiao ..... 24/68 SK
2004/0250388 A1 * 12/2004 Martin ..... 24/712.5
2006/0042056 A1 * 3/2006 Min ..... 24/712.5
2006/0130297 A1 * 6/2006 Liao ..... 24/712.5
2007/0000105 A1 * 1/2007 Grande et al. ..... 24/712.5
2011/0016680 A1 * 1/2011 Chang ..... 24/712.5

* cited by examiner

*Primary Examiner* — Jack W. Lavinder
(74) *Attorney, Agent, or Firm* — Chun-Ming Shih

(57) ABSTRACT

A shoelace with a shoelace fastener includes a first retaining base at an end of a first lace and/or a second retaining base at another end of the first lace, and a ratchet and an elastic clipping element are disposed in the first retaining base and the second retaining base respectively, such that the ratchet can be pressed at an end of the elastic clipping element, and the ratchet is pressed by the elastic clipping element into a normal slantingly pressed down status. When use, a fabric shoelace or a serrated plastic groove is passed into the retaining base, and ends of the ratchets are provided for clamping a surface of the fabric shoelace or plastic shoelace to facilitate adjusting the tightness of the shoelace.

20 Claims, 21 Drawing Sheets

SHOELACE WITH SHOELACE FASTENER

BACKGROUND OF THE INVENTION

1. Field of the Invention

The present invention relates to a shoelace fixing technique for tying a shoelace and preventing the shoelace from being separated, and more particularly to a shoelace fastener and a shoelace structure that facilitate tying a shoelace and adjusting the tightness of the shoelace.

2. Description of the Related Art

In general, a shoe with a tying function usually includes a shoe surface disposed at the top surface of the shoe, and the surface has pairs of left and right symmetrical shoelace eyelets provided for passing through the shoelace eyelets alternately and adjusting the length of the shoelace that passes through the shoelace eyelets in order to adjust the tightness of the shoelace and achieve the effects of tying and fixing the shoe. Because the length of the upper shoe surface or the number of shoelace eyelets varies with different types of shoes, it is necessary to provide shoelaces with different lengths for different types of shoes, or else the shoes cannot be tied securely and may fall off easily.

However, a conventional shoelace still has the following drawbacks that require further improvements:

1. Most shoelaces are designed with one length, and both ends of a shoelace have a shoelace head individually provided for passing through the shoelaces eyelets alternately, such that if the shoelace is too long or too short, then another shoelace of an appropriate length must be used. If the shoelace head is cut to fit the length, then the shoelace may lose structure integrally or may easily splits from end.

2. When a conventional shoelace is used for tying, repeatedly adjusting the length of the shoelace between the shoelace eyelets is necessary, and then tie a bow-tie or any other types of knot to fix both ends of the shoelace. Obviously, the conventional way of tying the shoelaces takes time and effort. Furthermore, the shoelaces may be loosened easily.

3. The remaining section of a tied shoelace may be hooked by an object and cause the tied shoelace to loose easily, so shoe wearers may trip over the loosened shoelace and get hurt.

4. The knot of a tied shoelace is protruded and dropped at the shoe surface with lace holes. For exercises or ball games, the knot may touch the ball surface to produce irregular bouncing movements, and all these drawbacks are annoying to shoe wearers. Furthermore, a conventional fabric shoelace may get dirty easily and generally comes with no waterproof effect.

In view of the aforementioned shortcomings of the conventional shoelaces, the inventor of the present invention designed a novel shoelace with a shoelace fastener, wherein the shoelace fastener is provided for fastening a fabric shoelace or a plastic shoelace to overcome the conventional way of adjusting the length of the shoelaces and the drawbacks of a conventional shoelace knot. The design of a ratchet in accordance with the invention provides a convenient way of adjusting the length of the shoelace easily to achieve the effects of adjusting the tightness of the shoelace effectively and significantly enhancing the convenience for using.

SUMMARY OF THE INVENTION

Therefore, it is a primary objective of the present invention to provide a convenient way of using a shoelace fastener and tying a shoelace, so as to significantly enhance the convenience of tying the shoelace and simplify the procedure of tying the shoelace.

Another objective of the present invention is to provide a shoelace fastener for improving the convenience and adjusting the tightness of a shoelace quickly.

To achieve the foregoing objective, the present invention provides a shoelace fastener for clamping and fixing a shoelace to maintain the tightness of the shoelace, and the shoelace fastener comprises: a first lace; a first retaining base disposed at an end of the first lace, and having a containing space formed in the first retaining base, a pair of sidewall slots and at least one stops disposed on two sidewalls of an end of the first retaining base, and a first insert hole formed at another end of the first retaining base; a ratchet, including a pivoting portion pivotally installed into a sidewall slot of the first retaining base, a second insert hole formed, on the ratchet, and a catch portion disposed at an end of the ratchet, and another end of the ratchet being exposed from the first retaining base; and an elastic clipping element, with both ends inserted into the first insert hole and the second insert hole, for coupling the ratchet and the first retaining base respectively, such that when the shoelace is passed into the first retaining base, the catch portion of the ratchet is pressed downwardly to drive the ratchet to clamp and fix the shoelace by a resilience of the elastic clipping element, such that the invention can simplify the procedure of tying a shoelace and achieve the effects of facilitating the use of the shoelace and adjusting the tightness of the shoelace.

In a preferred embodiment, the first lace further includes a collar at another end of the first lace for passing a remaining portion of the shoelace through the collar to prevent the remaining portion from being warped, and a second retaining base at another end of the first lace, and the second retaining base also includes a ratchet and an elastic clipping element for fixing both ends of the shoelace, and the first retaining base and the second retaining base are provided for passing the ends of the shoelace respectively. In another preferred embodiment, the first lace further includes a first fixing portion at another end (opposite to an end of the first retaining base) of the first lace, wherein the shoelace is a second lace includes a serrated groove disposed at an end of the second lace and corresponding to the ratchet, and a second fixing portion disposed at another end of the second lace, and the first fixing portion and the second fixing portion are disposed at symmetric positions of a shoe surface with lace holes, and a curved portion is disposed separately at a connecting position of the first lace and the first fixing portion, and a connecting position of the second lace and the second fixing portion, so as to facilitate a quick and convenient installation and a quick adjustment of the length between the first lace and the second lace and improve the convenience of making an adjustment.

Another objective of the present invention is to provide a shoelace with the shoelace fastener for facilitating an installation of the lace onto a shoe surface with lace holes quickly and adjusting the tightness of the shoelace conveniently.

To achieve the aforementioned objective, the present invention provides a shoelace with a shoelace fastener installed onto a shoe surface with lace holes, and the shoelace comprises: a first lace; a first retaining base disposed at an end of the first lace, and having a containing space formed in the first retaining base, a pair of sidewall slots and at least one stops disposed on two sidewalls of an end of the first retaining base, and a first insert hole formed at another end of the first retaining base; a ratchet, including a pivoting portion pivotally installed into a sidewall slot of the first retaining base, a second insert hole formed on the ratchet, and a catch portion disposed at an end of the ratchet, and another end of the ratchet are exposed form the first retaining base; an elastic clipping element, with both ends inserted into the first insert hole and the second insert hole, for coupling the ratchet and the first retaining base respectively; and a third lace, coupled to another end of the first lace, and having a serrated groove formed at another end of the third lace, such that when the third lace is passed into the inner side of the first retaining base, the catch portion of the ratchet is pressed downwardly to drive the ratchet to clamp and fix the shoelace in the serrated groove by a resilience of the elastic clipping element, and thus the invention can simplify the procedure of tying a shoelace and achieve the effects of facilitating the use of the shoelace and adjusting the tightness of the lace.

The first lace also includes a collar at another end of the first lace for passing a remaining portion of a third lace to prevent the remaining portion from being warped. In this preferred embodiment, the first lace, the first retaining base and the third lace plastic are integrally formed by a plastic injection molding to produce a plastic shoelace, and thus not only lowering the manufacturing cost, but also giving the waterproof and stainproof advantages. In addition, a curved portion is disposed at a connecting position of the first lace and the third lace, and an end of a serrated groove of the third lace is spirally curled.

DETAILED DESCRIPTION OF THE PREFERRED EMBODIMENTS

Figure 1:
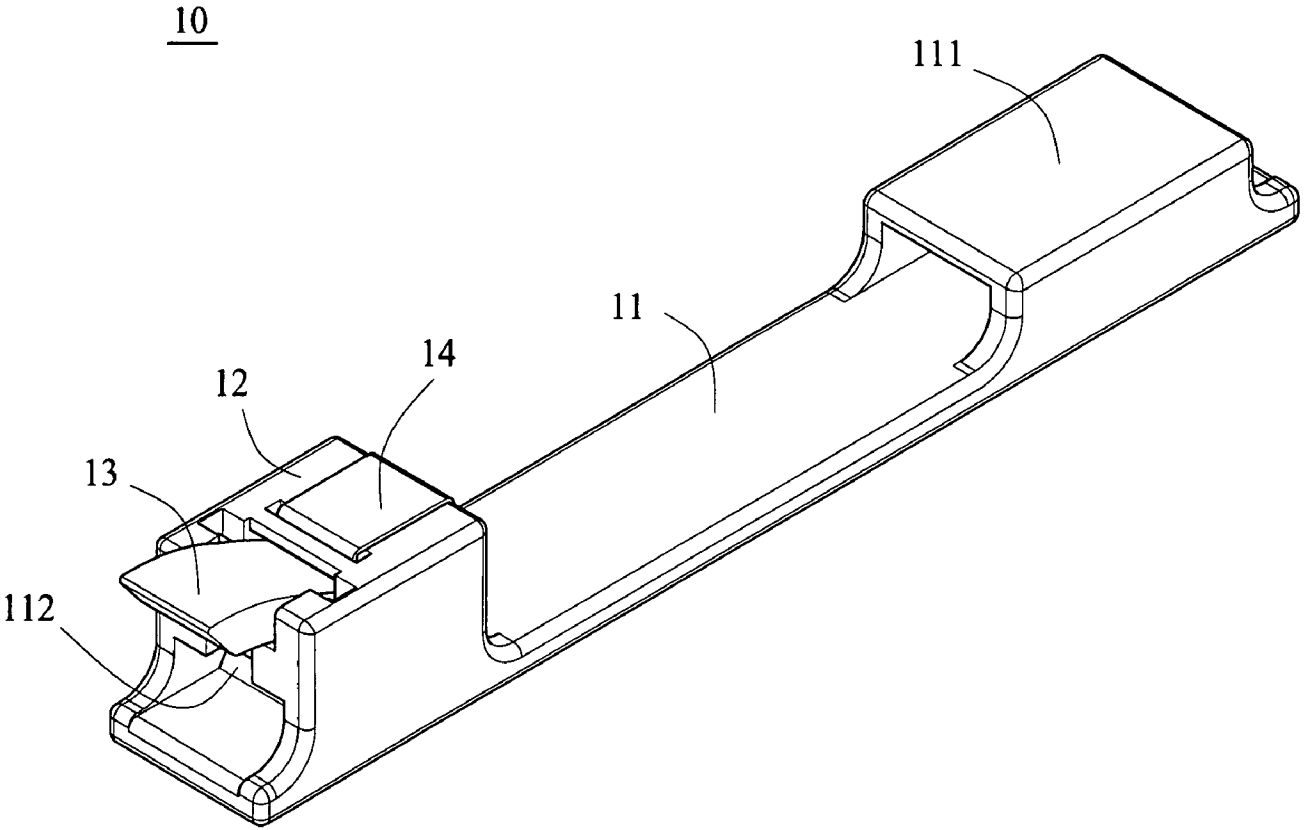
FIG. 1 is a three-dimensional view of a shoelace fastener in accordance with a first preferred embodiment of the present invention.

The present invention will become apparent with the detailed description of the following embodiments with accompanied drawings as follows.

With reference to FIGS. 1 to 4 for a three-dimensional view, a partial enlarged view, a schematic view of a shoelace fastener installed onto a surface with lace holes, and a schematic view of adjusting a shoelace in accordance with a first preferred embodiment of the present invention respectively. The shoelace fastener 10 is provided for clamping and fixing a shoelace 20 (particularly a common fabric cloth) to maintain the tightness of the shoelace 20, and the shoelace fastener 10 comprises a first lace 11, a first retaining base 12, a ratchet 13, and an elastic clipping element 14.

Wherein, the first lace 11 is substantially a flat structure in the shape of a long strip, and includes a collar 111 disposed at an end of the first lace 11 for passing the shoelace 20.

The first retaining base 12 is disposed at another end of the first lace 11, and a containing space is formed inside the first retaining base 12 for passing the shoelace 20, a pair of sidewall slots 121 and at least one stops 122 are disposed on two sidewalls of an end of the first retaining base 12, and a first insert hole 123 is formed at another end of the first retaining base 12.

The ratchet 13 includes a pivoting portion 131 pivotally installed into the pivoting hole 121 of the first retaining base 12, a second insert hole 132 formed on the ratchet 13, and a catch portion 133 disposed at an end of the ratchet 13, wherein another end of the ratchet 13 is exposed from the first retaining base 12.

The elastic clipping element 14 is made of plastic and formed into a substantially n-shape by bending the elastic clipping element continually, and both ends of the elastic clipping element 14 are inserted into the first insert hole 123 and the second insert hole 132 for coupling the ratchet 13 and the first retaining base 12 respectively, such that when both ends of the shoelace 20 are passed into the inner side of the first retaining base 12, the ratchet 13 is pressed downwardly by the resilience of the elastic clipping element 14 to maintain the ratchet 13 in a normally pressing down status. In addition, a serrated structure 112 is disposed on an internal surface of the first retaining base 12, which the internal surface opposites to a surface of the first lace 11 of the ratchet 13.

Figure 3:
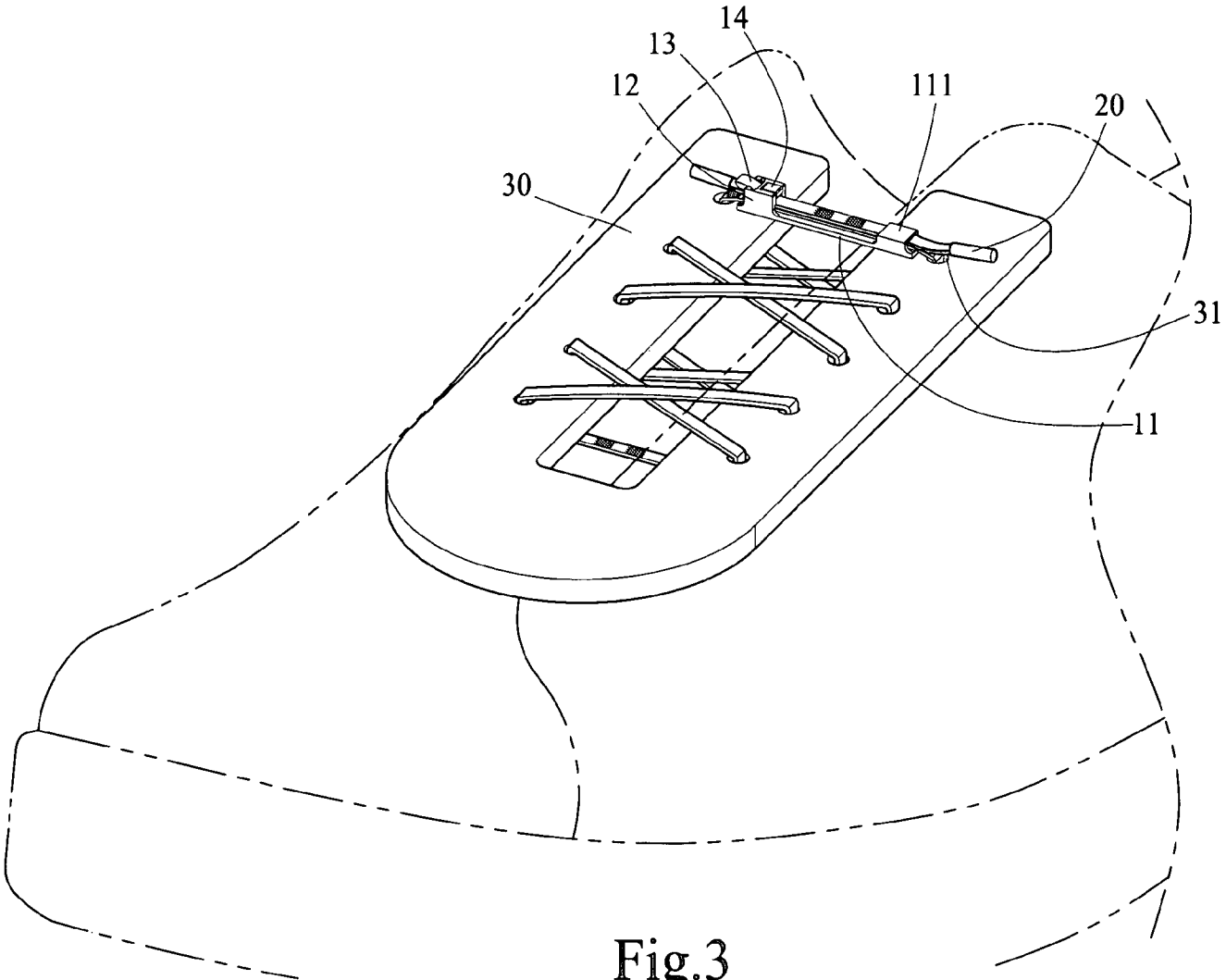
FIG. 3 is a schematic view of a shoelace fastener installed onto an upper shoe surface in accordance with a first preferred embodiment of the present invention.
Figure 4:
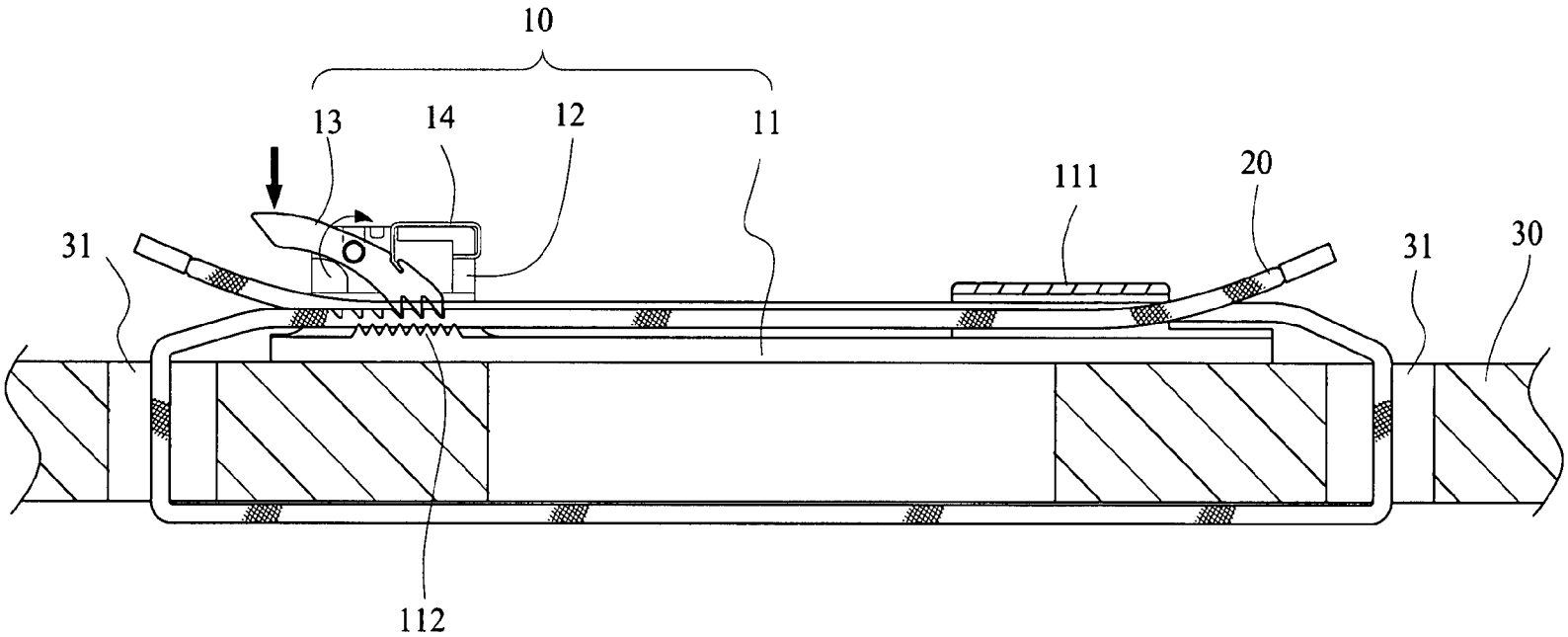
FIG. 4 is a schematic view of adjusting a shoelace in accordance with a first preferred embodiment of the present invention.
Figure 5:
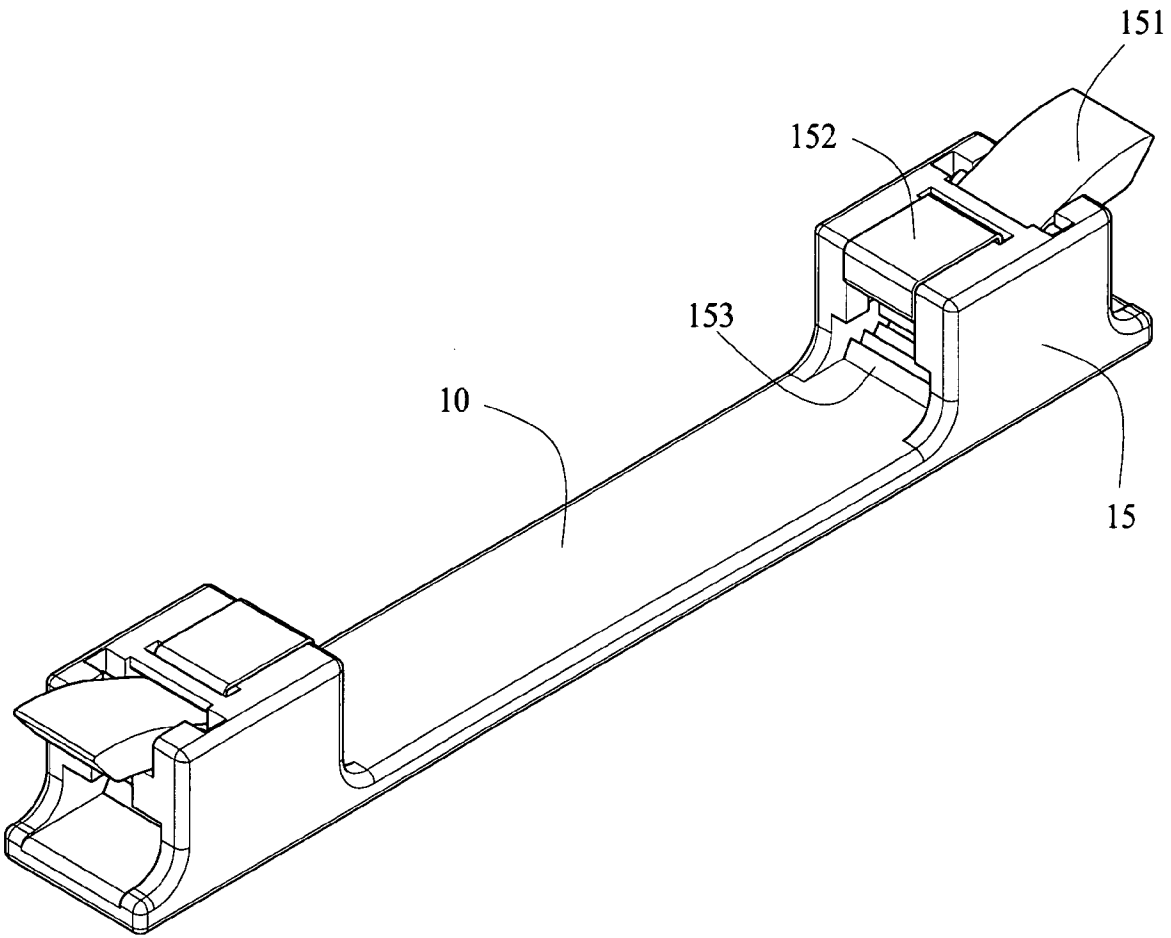
FIG. 5 is a three-dimensional view of a shoelace fastener in accordance with a second preferred embodiment of the present invention.

With reference to FIGS. 3 and 4 for a shoelace fastener installed onto a surface with lace holes in accordance with a first preferred embodiment of the present invention, the shoelace 20 is passed through each shoelace eyelet 31 of the shoe surface 30 with lace holes, and both ends of the shoelace 20 are passed out from the shoe surface 30 with lace holes, and passed into the first retaining base 12 (either in the same or opposite direction) to press the ratchet 13 down, such that both ends of the shoelace 20 can be passed into the first retaining base 12. After the ratchet 13 is released, the ratchet 13 is pressed downwardly by the resilience of the elastic clipping element 14, and the shoelace 20 is clamped and fixed by the catch portion 133 and the serrated structure 112 on the surface of the first lace 11, and thus it is not necessary to tie the shoelace 20 anymore so as to provide a convenient application, and the present invention also makes use of pressing the ratchet 13 downwardly to produce a release effect and provide a quick and convenient way of adjusting the tightness of the shoelace 20. In addition, the collar 111 of the first lace 11 is provided for passing the remaining portion of the shoelace 20 and preventing such portion from being warped.

With reference to FIGS. 5 to 8 for a three-dimensional view and a schematic view of a shoelace fastener structure, a schematic view of installing a shoelace fastener onto the shoe surface with lace holes, and a schematic view of adjusting a shoelace in accordance with a first preferred embodiment of the present invention respectively, a second retaining base 15 is disposed at another end (which is also the original position of installing the collar 111) of the first lace 11, and the second retaining base 15 also includes a ratchet 151 and an elastic clipping element 152 therein, and an internal surface of the second retaining base 15 is also a serrated structure 153 opposite to the surface of the first lace 11 of the ratchet 151, such that both ends of the shoelace fastener can be used for fixing the shoelace 20 (particularly for a fabric shoelace).

Figure 6:
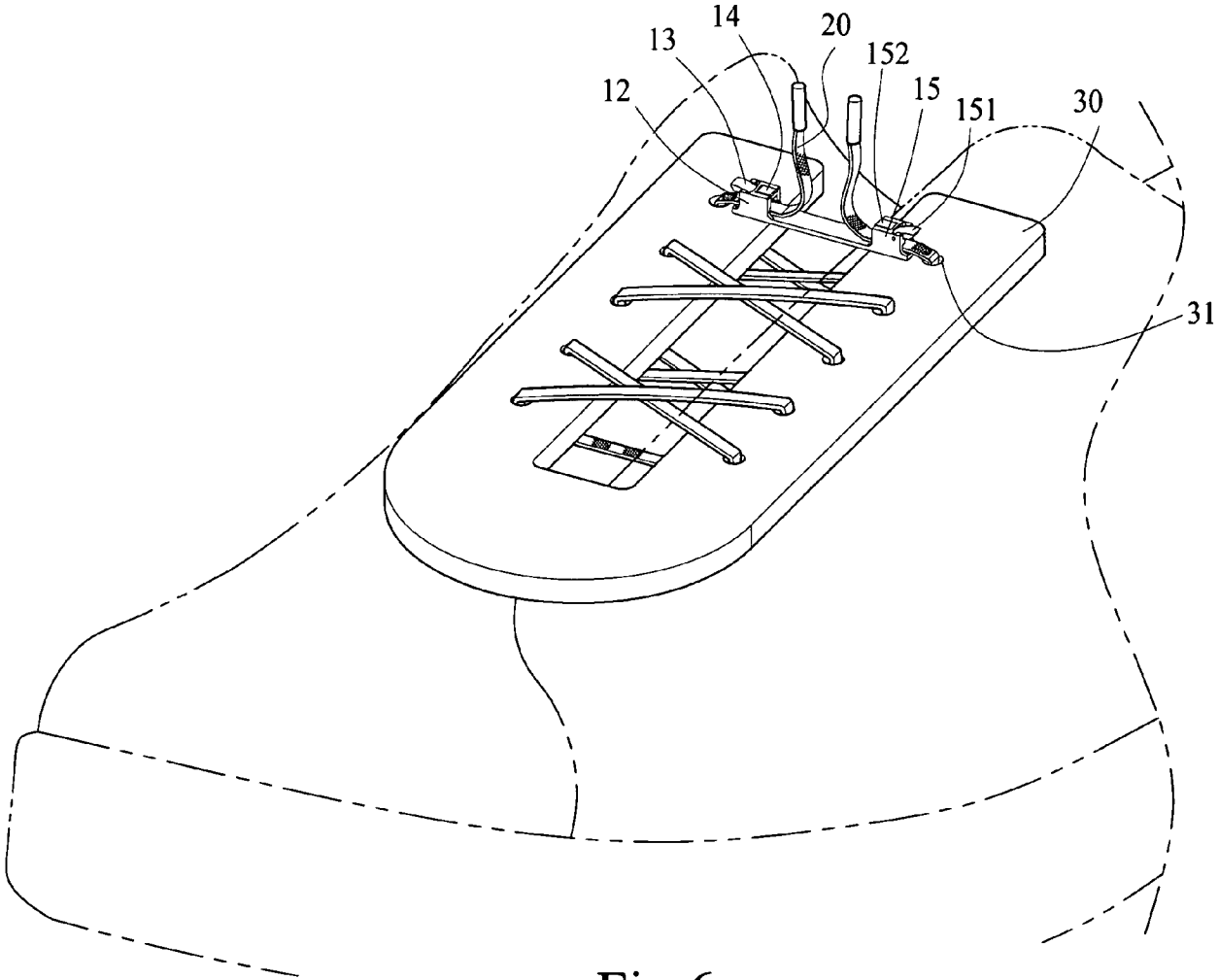
FIG. 6 is a schematic view of a shoelace fastener installed onto a shoe surface with lace holes in accordance with a second preferred embodiment of the present invention.
Figure 7:
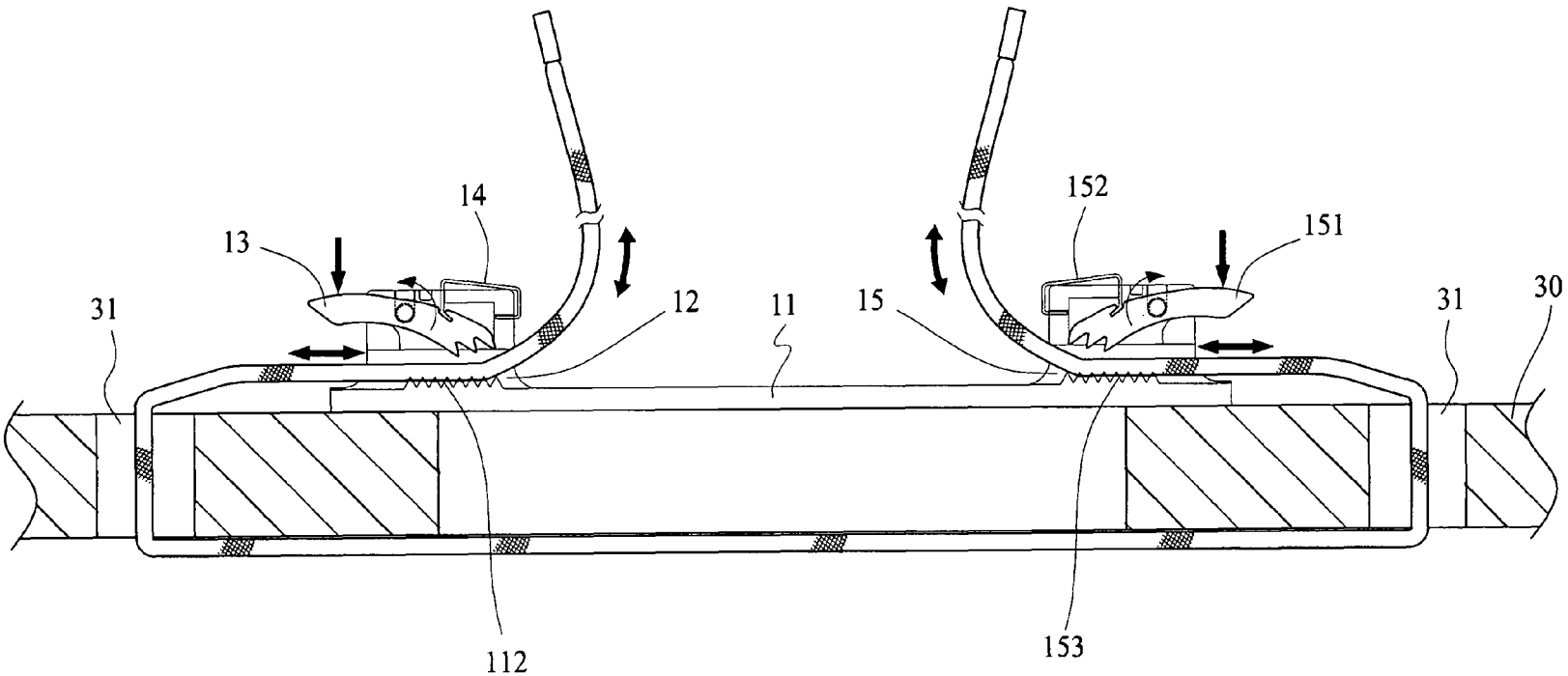
FIG. 7 is a schematic view of adjusting a shoelace in accordance with a second preferred embodiment of the present invention.
Figure 8:
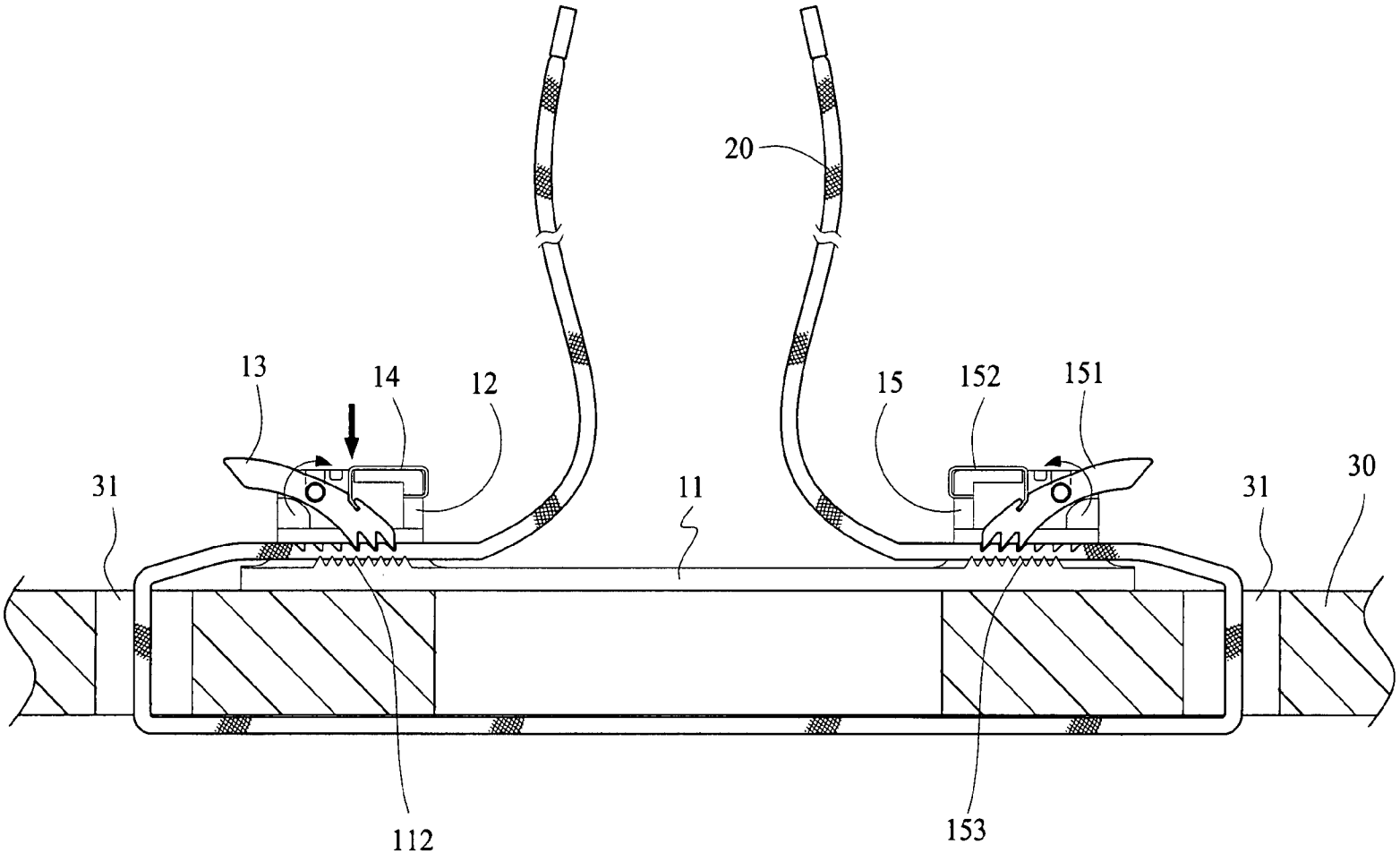
FIG. 8 is another schematic view of adjusting a shoelace in accordance with a second preferred embodiment of the present invention.

In FIGS. 6, 7, 8, both ends of the shoelace 20 are passed into the first retaining base 12 and the second retaining base 15 respectively, and the ratchet 13 on the first retaining base 12 and the ratchet 151 on the second retaining base 15 are used for clamping and fixing the ends of the shoelace 20 to provide a convenient installation and eliminate the inconvenience of tying the shoelace 20. The ratchet 13 of the first retaining base 12 or the ratchet 151 of the second retaining base 15 is pressed, or both ratchets 13, 151 are pressed simultaneously, and a single side is used or both sides are used simultaneously to pull the shoelace 20 to achieve the effects of adjusting the length and tightness of the shoelace 20, and providing a simple and convenient operation without the need of tying the shoelace repeatedly.

Figure 9:
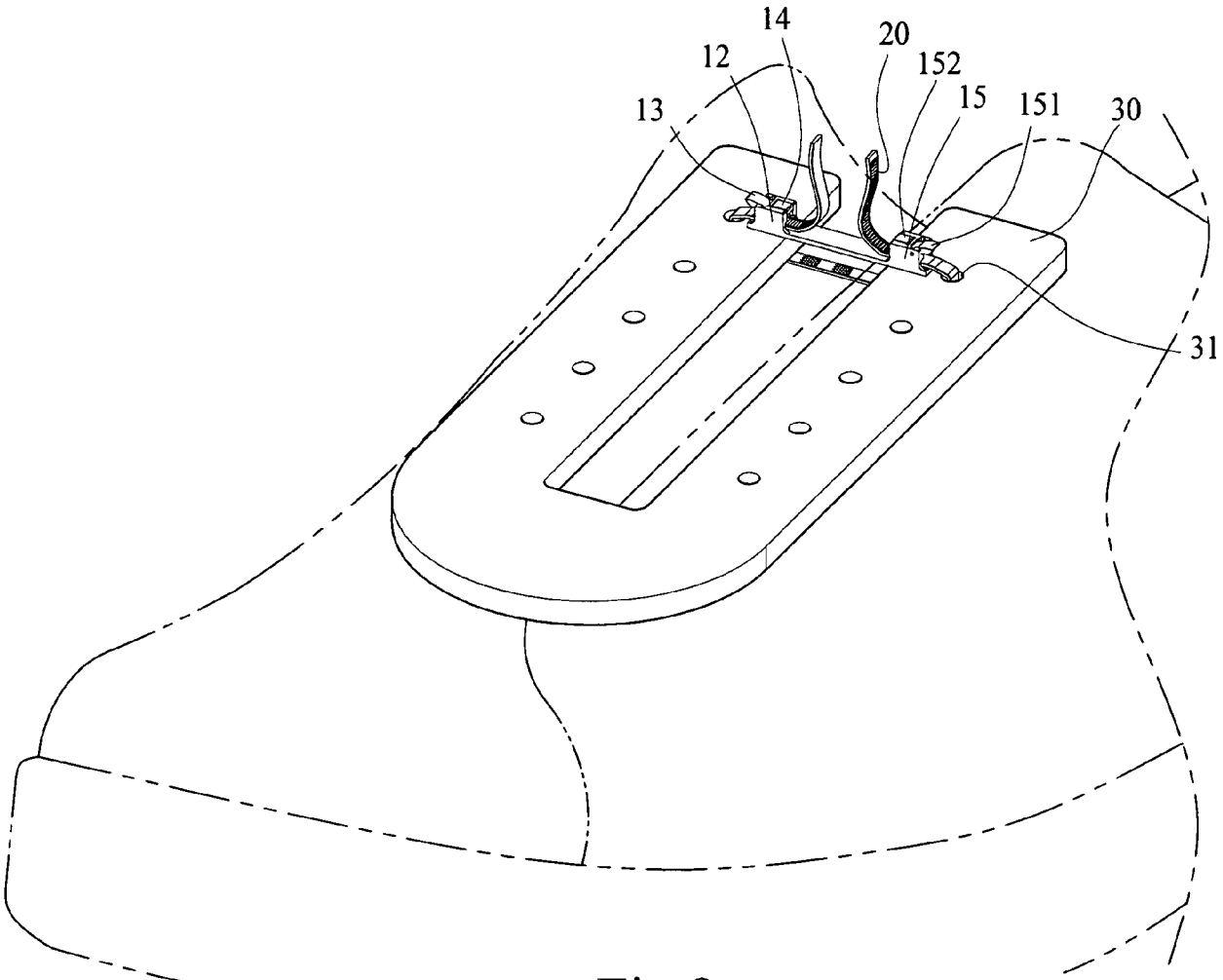
FIG. 9 is a schematic view of a shoelace fastener installed onto a shoe surface with lace holes in another way in accordance with a second preferred embodiment of the present invention.
Figure 10:
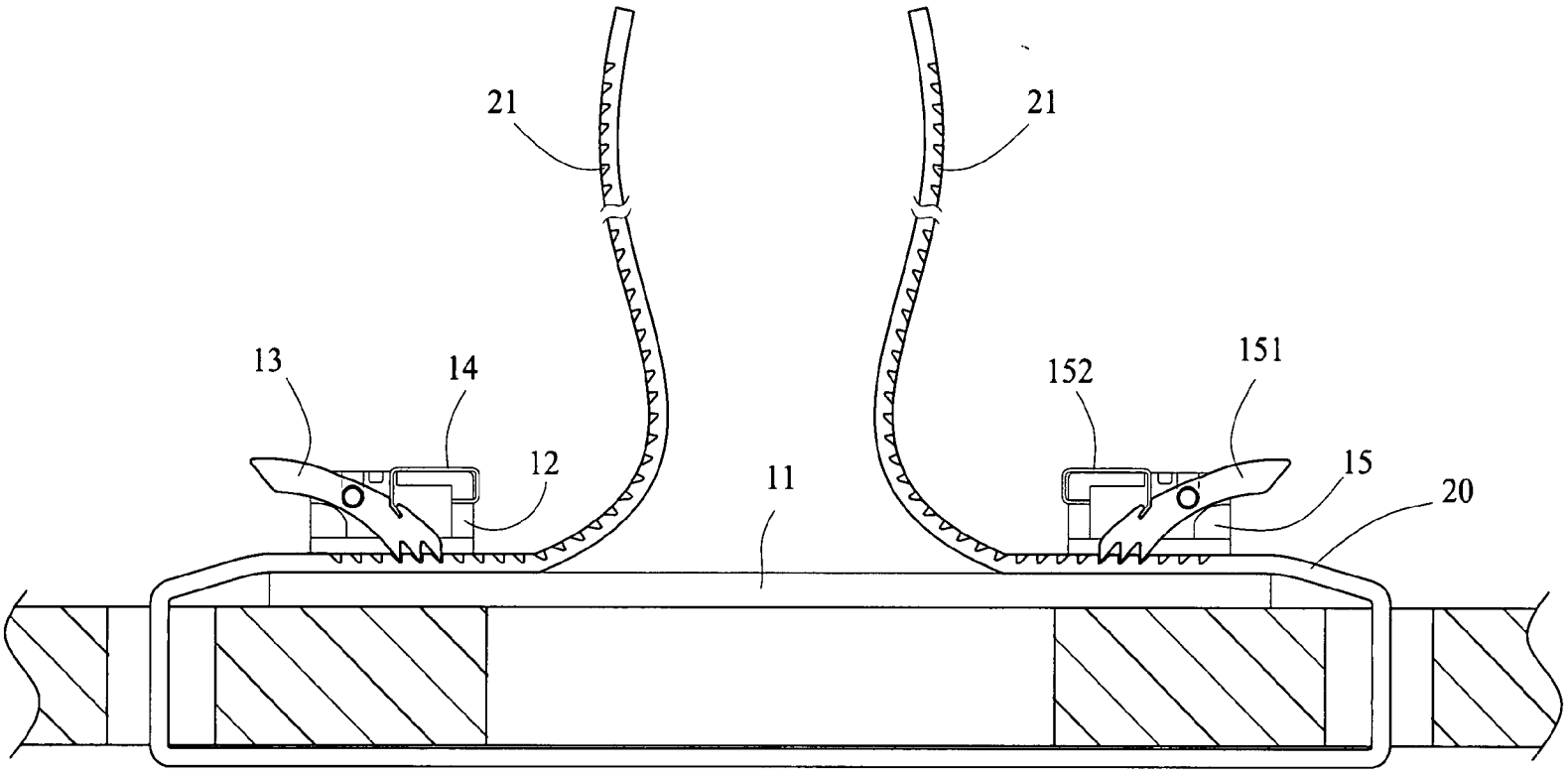
FIG. 10 is a schematic view of adjusting a shoelace by another way in accordance with a second preferred embodiment of the present invention.
Figure 11:
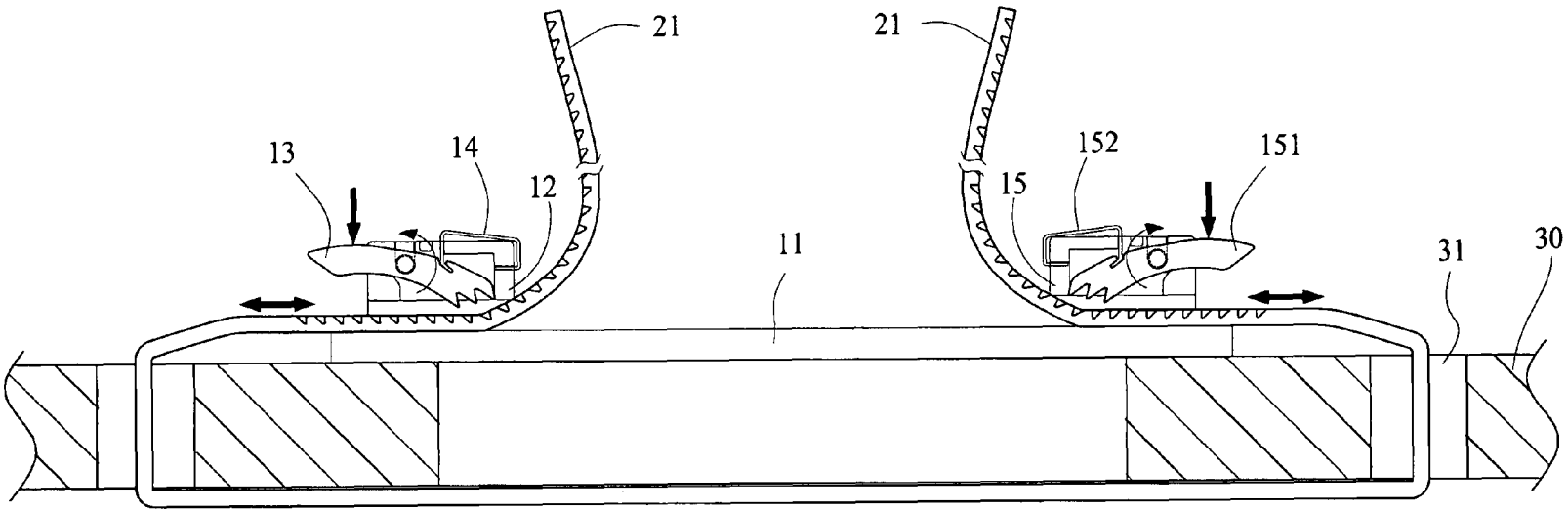
FIG. 11 is another schematic view of adjusting a shoelace by another way in accordance with a second preferred embodiment of the present invention.
Figure 12:
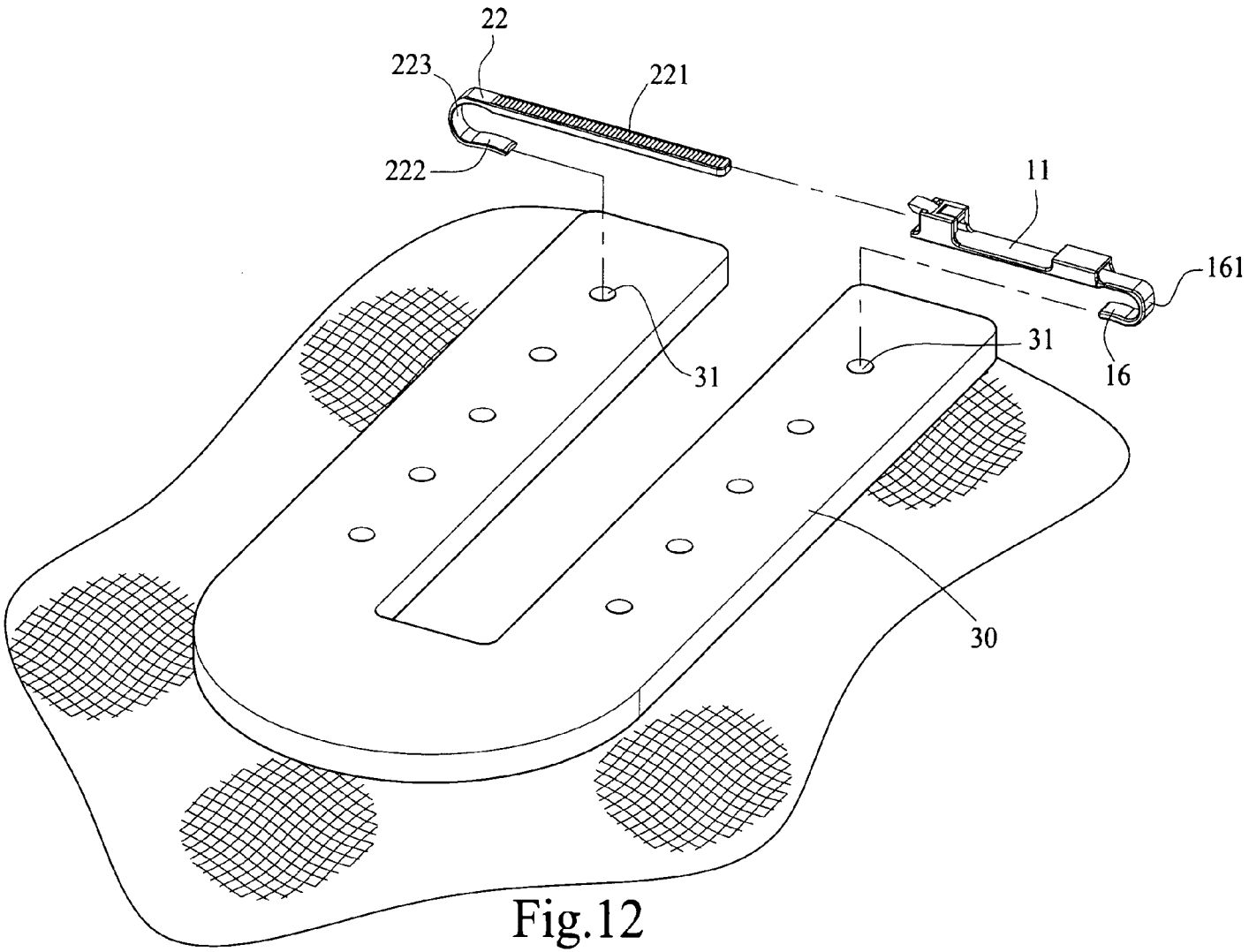
FIG. 12 is an exploded view of a shoe lace fastener in accordance with a third preferred embodiment of the present invention.
Figure 13:
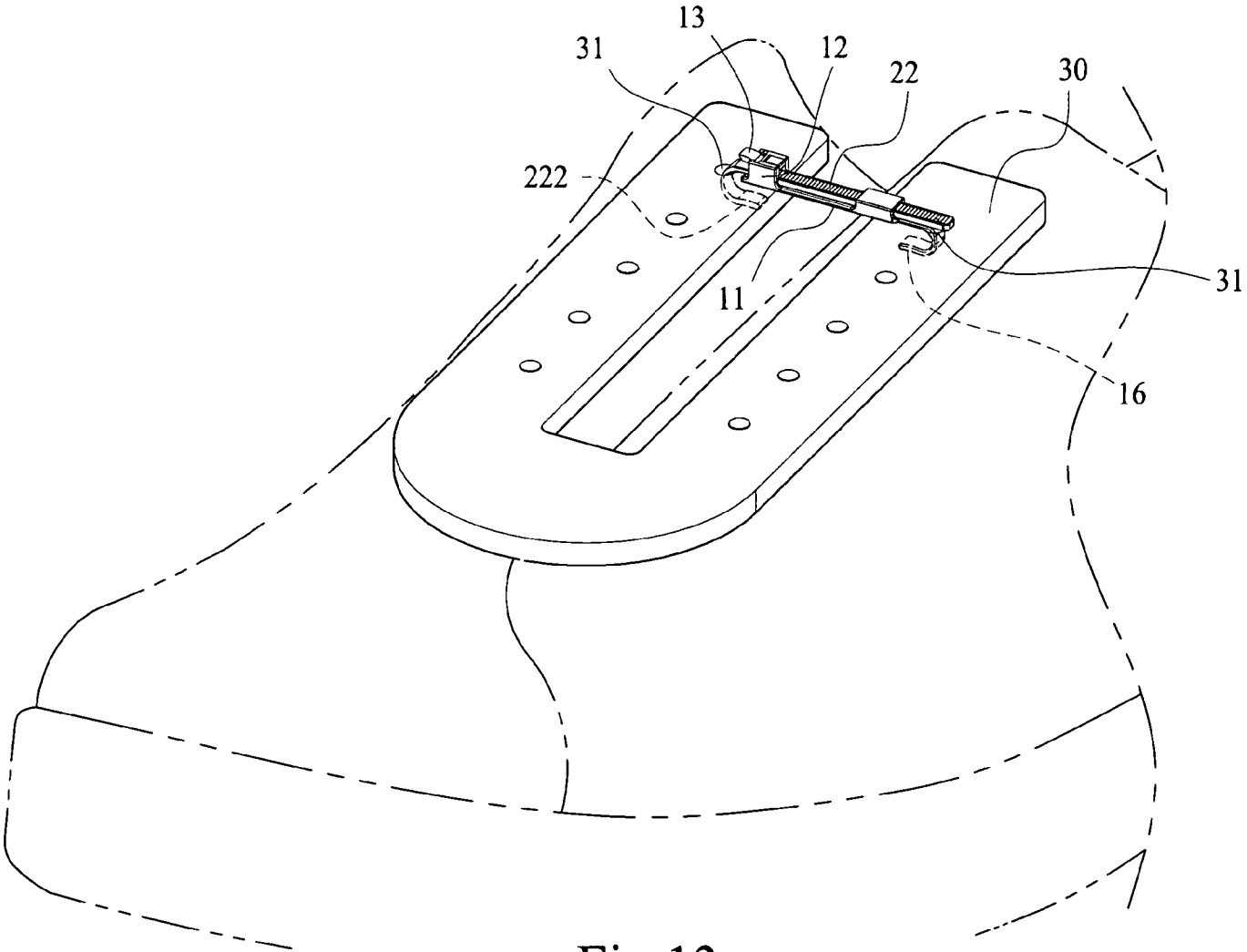
FIG. 13 is a schematic view of installing a shoe lace fastener onto a shoe surface with lace holes in accordance with a third preferred embodiment of the present invention.

With reference to FIGS. 9 to 11 for a schematic view of a shoelace fastener installed onto shoe surface with lace holes and schematic views of adjusting a shoelace in accordance with a second preferred embodiment of the present invention, the shoelace 20 is a plastic shoelace integrally formed by a plastic injection molding process, and each end of the shoelace 20 has a serrated groove 21.

In FIGS. 10 and 11, the shoelace 20 is sequentially passed into the symmetric shoelace eyelets 31 of the shoe surface 30 with lace holes. After both ends of the shoelace 20 are passed out from the surface 30 with lace holes, both ends of the shoelace 20 are passed into the first retaining base 12 and the second retaining base 15 respectively. Since the serrated grooves 21 and the ratchets 12, 151 come with serrated lines arranged in opposite directions, the ratchets 12, 151 will be pushed away, and the serrated grooves 21 will be latched and secured by the ratchets 12, 151 after the serrated groove 21 of the shoelace 20 is passed into the retaining base. To make an adjustment of the shoelace 20, the ratchets 12, 151 are pressed downwardly and separated from the serrated grooves 21 to define a release status. By pressing the ratchets 12, 151, the ratchets 12 151 will be released from serrated groove 21, thus the tightness of the shoelace 20 can be adjusted. When the ratchets 12, 151 are released, the ratchets 12,151 will be repressed again by the resilience of the elastic clipping element 14, and the ratchets 12, 151 will latch into the serrated grooves 21 of the shoelace 20. By doing so, the adjustment can be made easily and conveniently.

With reference to FIGS. 12 to 15 for an exploded view of a shoelace fastener, a schematic view of installing a shoe lace fastener onto a shoe surface with lace holes, and schematic views of adjusting a shoe lace in accordance with a third preferred embodiment of the present invention, a first fixing portion 16 (which is an inverted-hook structure as shown in the figures) is disposed at another end of the first lace 11 (opposite to an end of the first retaining base 12), and the shoelace 20 is a second lace 22, having a serrated groove 221 corresponding to the ratchet 13 and disposed at an end of the second lace 22, and a second fixing portion 222 (which is also an inverted-hook structure) is disposed at another end of the second lace 22, and a curved portion 161, 223 is disposed separately at a connecting position of the first lace 11 and the first fixing portion 16, and a connecting position of the second lace 22 and the second fixing portion 222. It is noteworthy to point out that the curved portions 161, 223 are formed by bending the first lace 11 or the second lace 15 by at least 90 degrees, and the curved portions 161, 223 are divided into upper and lower sections, wherein the thickness of the upper curved portions 161, 223 is increased for enhancing the strength of the curved portions 161, 223 and latching into the shoelace eyelets 31 on the surface 30 with lace holes, and the lower curved portions 161, 223 are used for adjusting the length of the second lace 15. For meet the requirements of the length and tightness, the lower curved portions 161, 223 comes with a thickness of less than the thickness of the upper curved portions 161, 223 to facilitate bending the first and second laces 11, 15.

Figure 14:
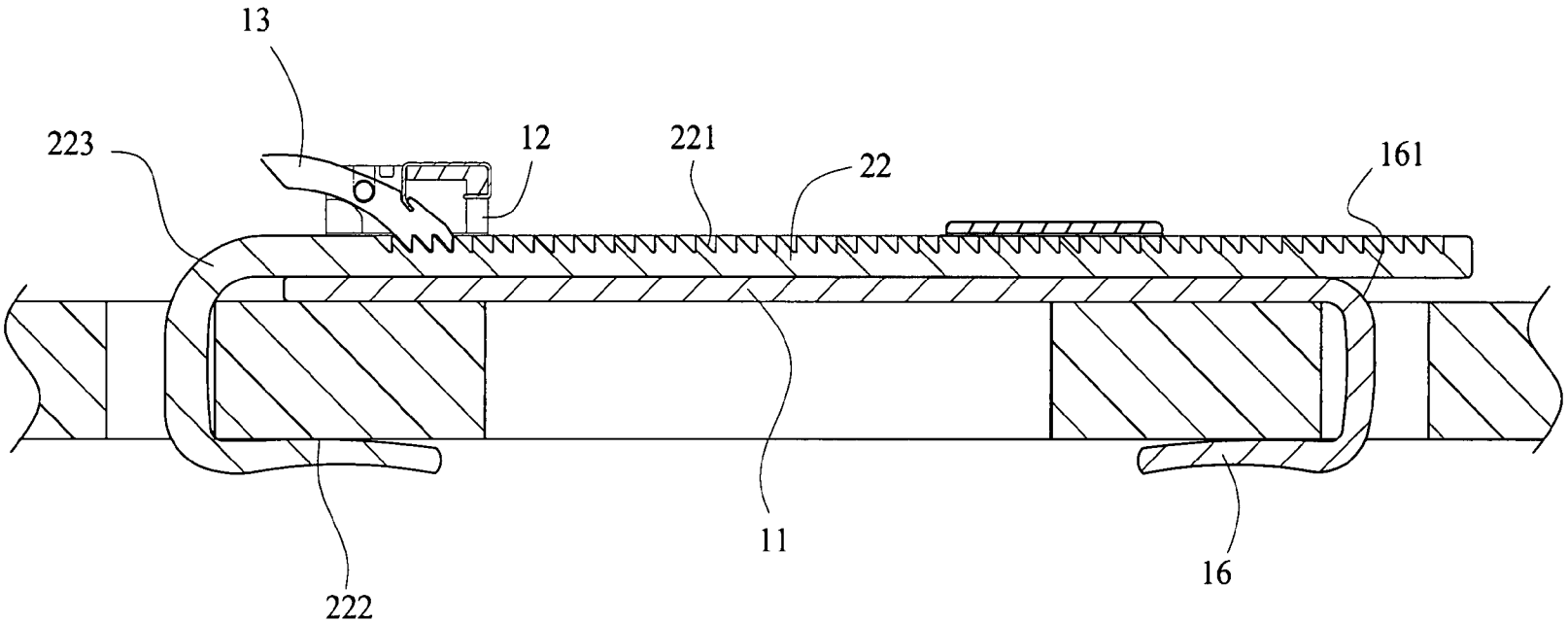
FIG. 14 is a schematic view of adjusting a shoelace in accordance with a third preferred embodiment of the present invention.
Figure 15:
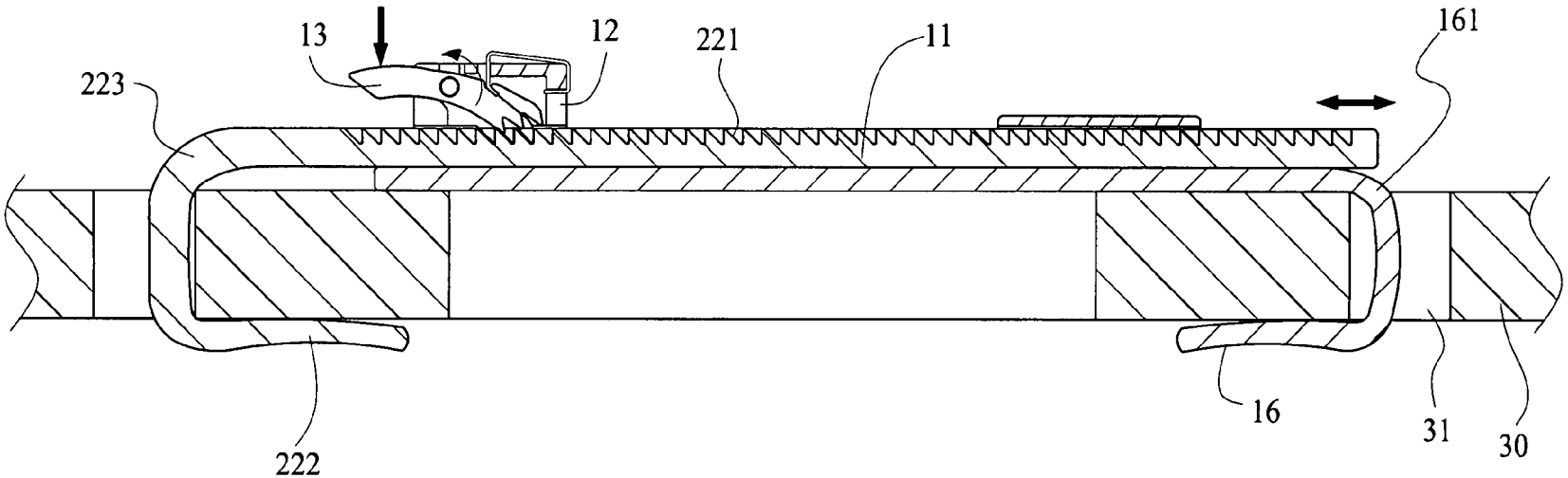
FIG. 15 is another schematic view of adjusting a shoelace in accordance with a third preferred embodiment of the present invention.

With reference to FIGS. 14 and 15, the first fixing portion 16 and the second fixing portion 222 are fixed into the shoelace eyelets 31 by hooking at symmetric positions of the shoe surface 30 with lace holes, and the serrated groove 221 of the second lace 22 is passed into the inner side of the first retaining base 12, such that the ratchet 13 on the first retaining base 12 are latched and fixed to the second lace 22 to achieve a quick and easy installation. For preceding an adjustment, the ratchet 13 is pressed downwardly to release the second lace 22 to facilitate adjusting the length and tightness between the first lace 11 and the second lace 22 in a simple and easy manner.

Figure 2:
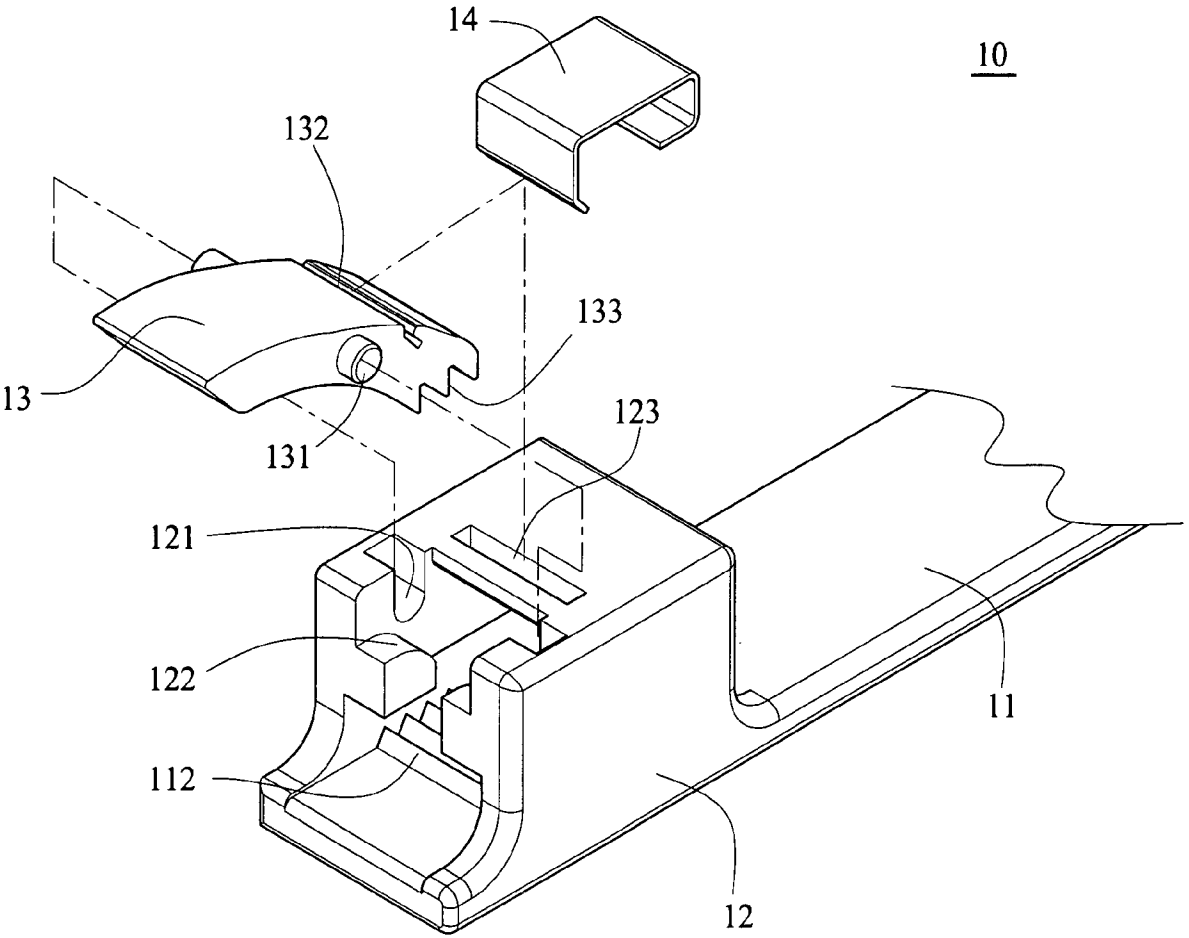
FIG. 2 is a partial enlarged view of a shoelace fastener in accordance with a first preferred embodiment of the present invention.
Figure 16:
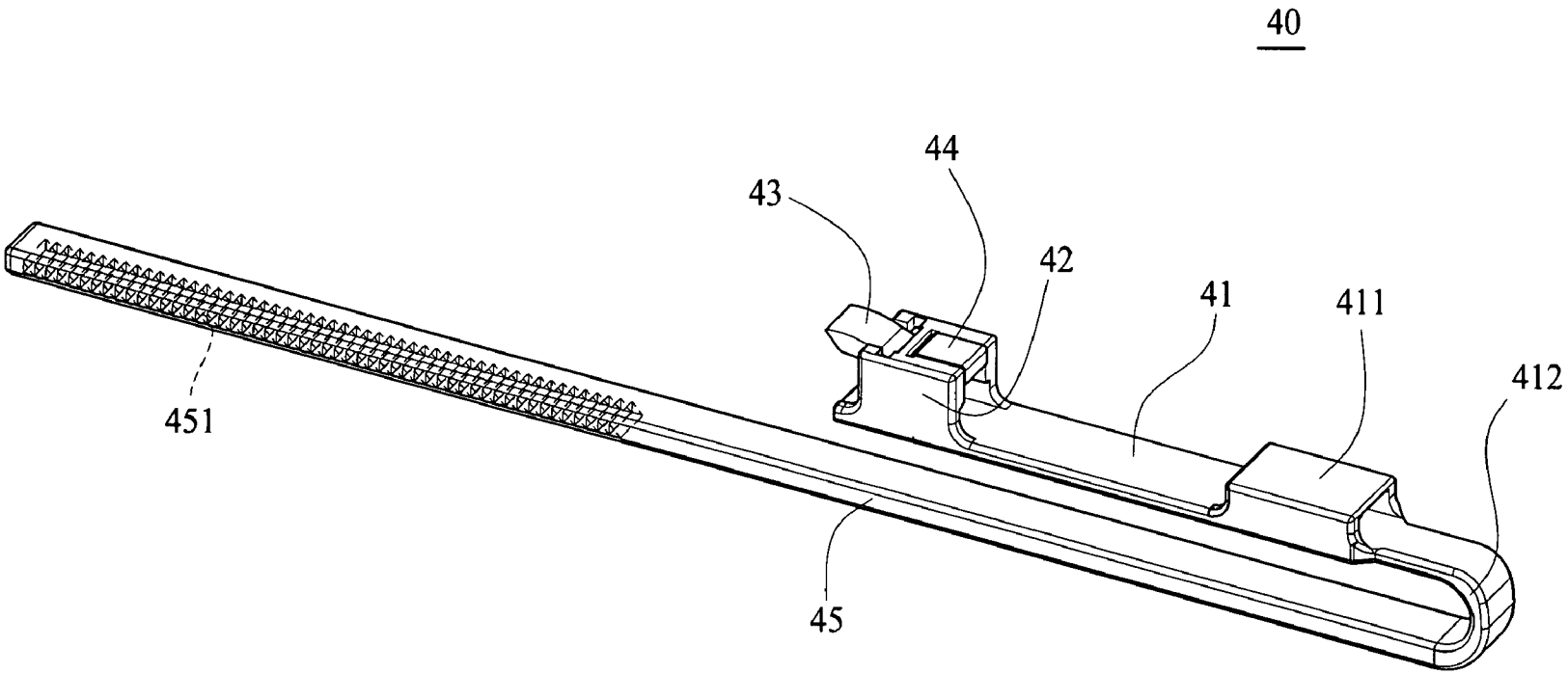
FIG. 16 is a three-dimensional view of a shoelace fastener in accordance with a fourth preferred embodiment of the present invention.
Figure 17:
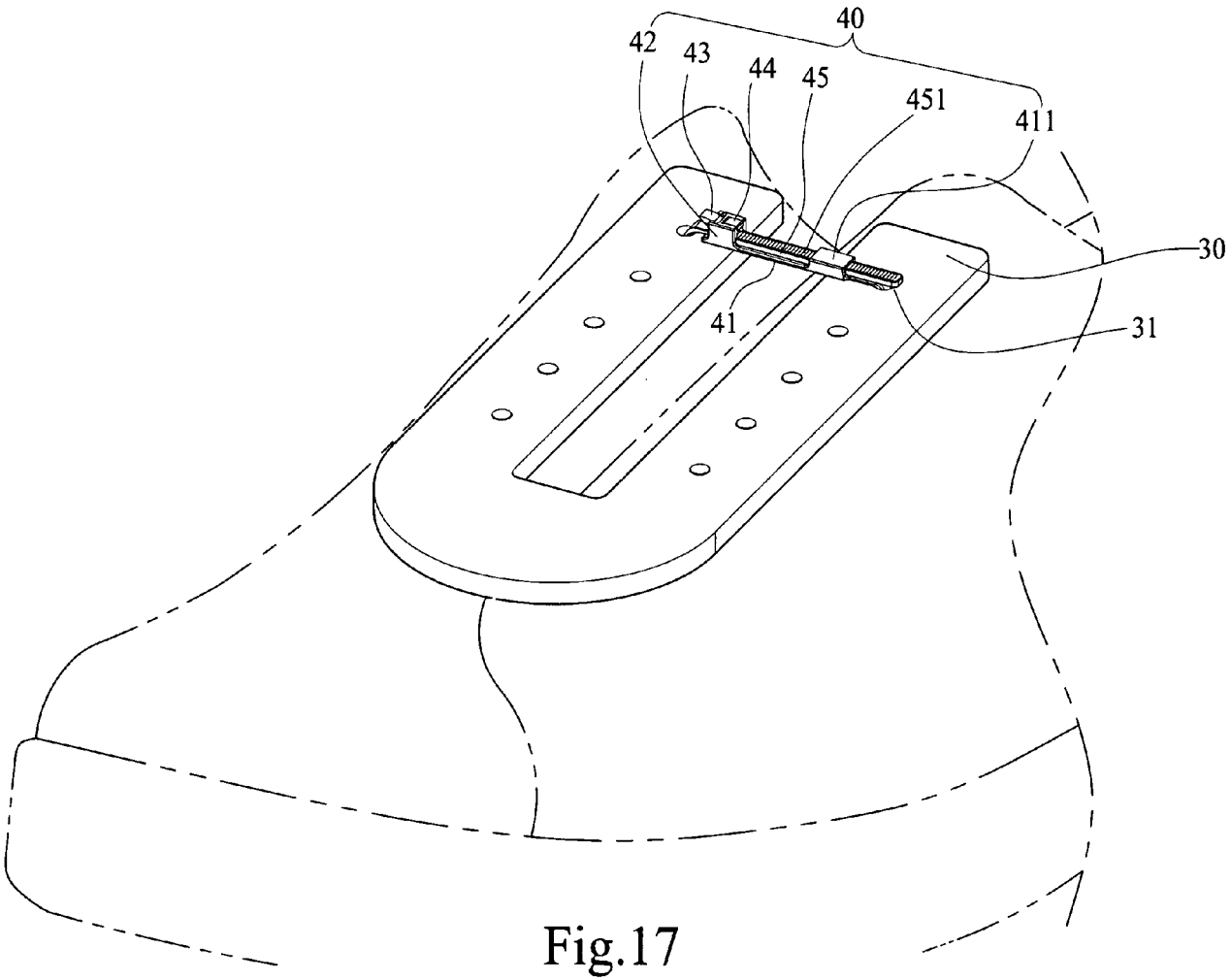
FIG. 17 is a schematic view of installing a shoe lace fastener onto a shoe surface with lace holes in accordance with a fourth preferred embodiment of the present invention.
Figure 18:
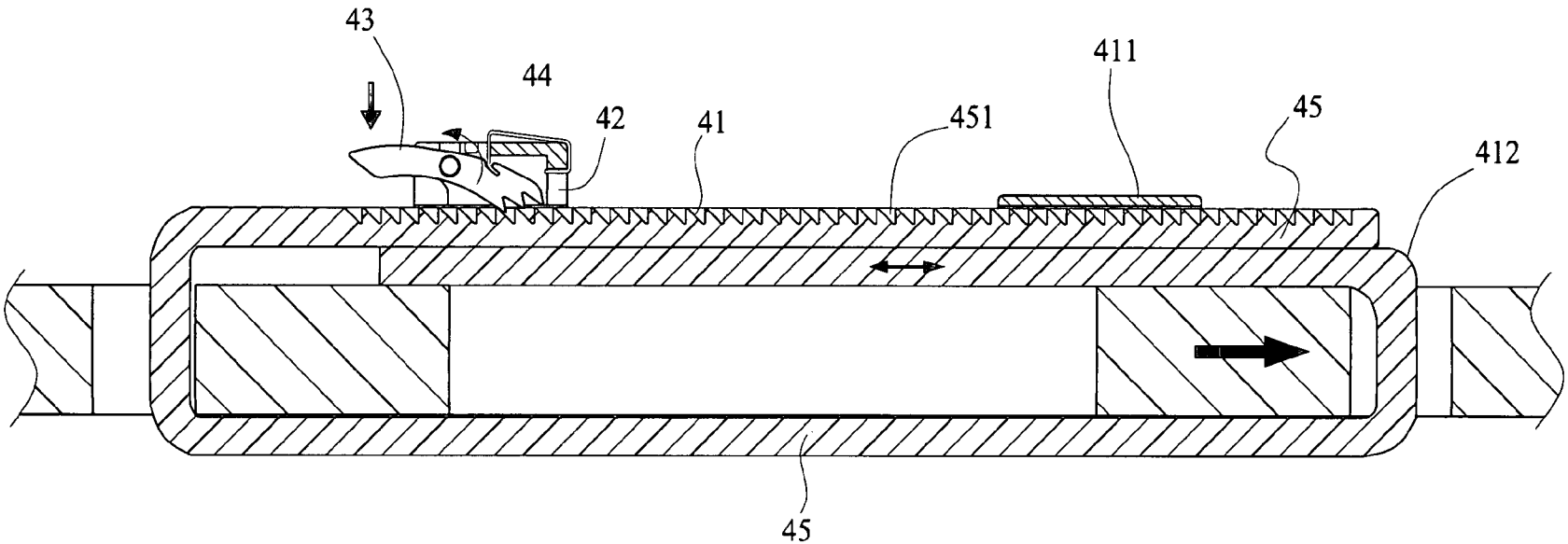
FIG. 18 is a schematic view of adjusting a shoelace in accordance with a fourth preferred embodiment of the present invention.

With reference to FIGS. 16 to 18 for a three-dimensional view, a schematic view of installing a shoelace fastener onto a shoe surface with lace holes, and a schematic view of adjusting a shoelace in accordance with a fourth preferred embodiment of the present invention respectively, a shoelace 40 having a shoelace fastener is passed through a shoe surface 30 with lace holes, and the shoelace 40 is integrally formed by a plastic injection molding, and the shoelace 40 comprises: a first lace 41, having a collar 411 at an end of the first lace 41;

a first retaining base 42, disposed at another end of the first lace 41, and having a containing space in the first retaining base 42, wherein the first retaining base 42 has the same structure of the first retaining base 12 as shown in FIG. 2, and also includes a pair of sidewall slots (not shown in the figure) and at least one stops (not shown in the figure), and another end of the first retaining base 42 also has a first insert hole (not shown in the figure); a ratchet 43 has the same structure of the ratchet 13 as shown in FIG. 2, and a pivoting portion (not shown in the figure) pivotally coupled into the sidewall slot of the first retaining base 42, and the ratchet 43 has a second insert hole (not shown in the figure) disposed thereon, and a catch portion (not shown in the figure) disposed at an end of the ratchet 43, wherein another end of the ratchet 43 is exposed from the first retaining base 42; an elastic clipping element 44 has the same structure of the elastic clipping element 14 as shown in FIG. 2, and both ends of the elastic clipping element 44 are inserted into the first insert hole and the second insert hole for coupling the ratchet 43 and the fixing base 42 respectively; and a third lace 45, coupled to another end of the first lace 41, and a serrated groove 451 disposed at another end of the third lace 45, such that if the third lace 45 is passed into the first retaining base 42, the ratchet 43 is pressed downwardly by the resilience of the elastic clipping element 44, such that the ratchet 43 is pressed and clamped into the serrated groove 451 of the third lace 45. In addition, a curved portion 412 is formed at a connecting position of the first lace 41 and the third lace 45. It is noteworthy to point out that the curved portions 412 is formed by bending the first lace 41 by at least 90 degrees, and the curved portions 412 are divided into upper and lower sections, wherein the thickness of the upper curved portion 412 is increased to enhance the strength of the curved portions 412 and the upper curved portion 412 is latched into the shoelace eyelet 31 of a shoe surface 30 with lace holes, and the lower curved portion 412 has a thickness smaller than the upper curved portions 412 for an easy bending to meet the requirements of adjusting the length of the third lace 45 and the tightness of the shoelace.

In FIGS. 17 and 18, an end of the third lace 45 is sequentially passed through the shoelace eyelets 31 of the shoe surface 30 with lace holes. After the third lace 45 is passed out from the shoe surface 30 with lace holes and into the first retaining base 42, the ratchet 43 is latched to the third lace 45, and the third lace 45 can be passed into the collar 411 to prevent the third lace 45 from being warped to form a curled shoelace 40 at the surface 30 with lace holes and complete installing the shoelace 40, so as to provide a convenient installation. In addition, the adjustment is made in the same way as described in the aforementioned preferred embodiment, wherein the ratchet 43 is pressed and released to facilitate adjusting the length and tightness of the third lace 45. In this preferred embodiment, the first lace 41, the first retaining base 42 and the third lace 45 are integrally formed by a plastic injection molding to produce a plastic shoelace, and thus not only lowering the manufacturing cost, but also giving the waterproof and stainproof advantages.

Figure 19:
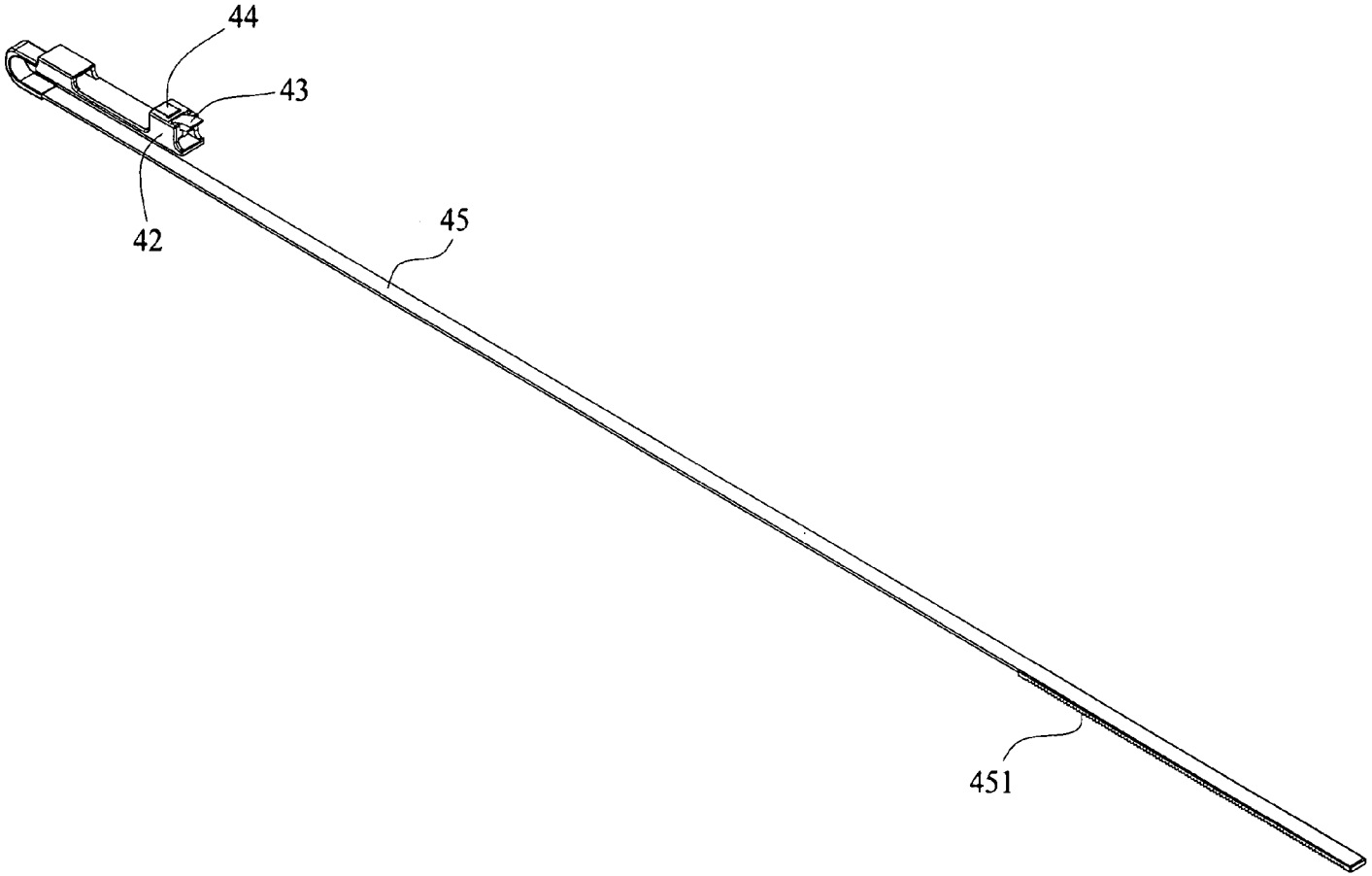
FIG. 19 is a three-dimensional view of another implementation in accordance with a fourth preferred embodiment of the present invention.
Figure 20:
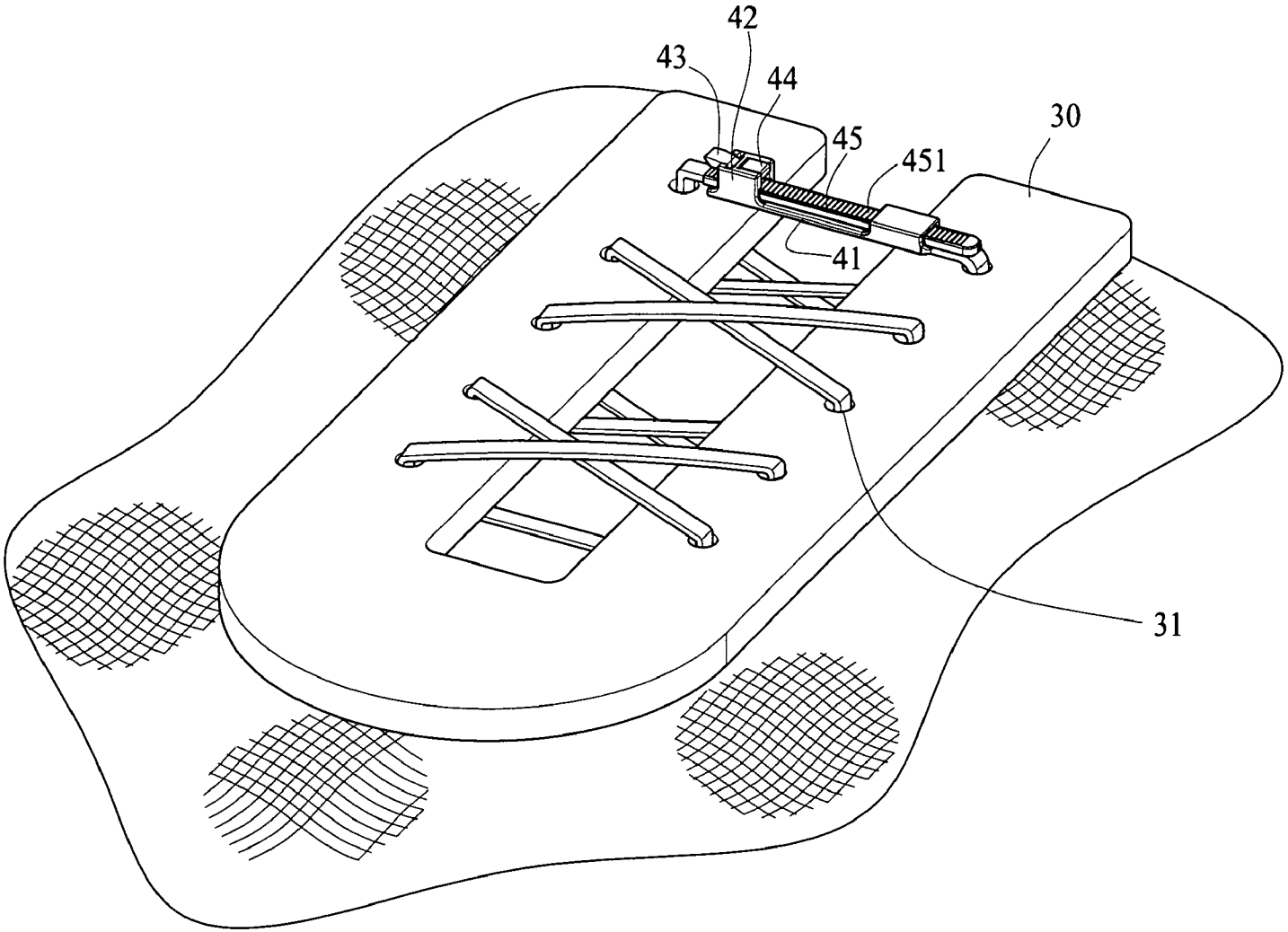
FIG. 20 is a schematic view of installing a shoelace fastener onto a shoe surface with lace holes in another way in accordance with a fourth preferred embodiment of the present invention.

With reference to FIGS. 19 and 20 for a three-dimensionalview, and a schematic view of installing a shoelace fastener onto a shoe surface with lace holes in accordance with another implementation of a fourth preferred embodiment of the present invention respectively, the length of the third lace 45 is increased, and the end of the third lace 45 also has a section of serrated grooves 451, such that the third lace 45 can be passed alternately into each shoelace eyelet 31 of the shoe surface 30 with lace holes, and the installation is the same as the installation of a general fabric shoelace, and the operating method is the same as the aforementioned preferred embodiment, wherein the third lace 45 is also passed into the first retaining base 42, and then the ratchet 43 is pressed by the resilience of the elastic clipping element 44 to achieve the effect of latching the third lace 45.

Figure 21:
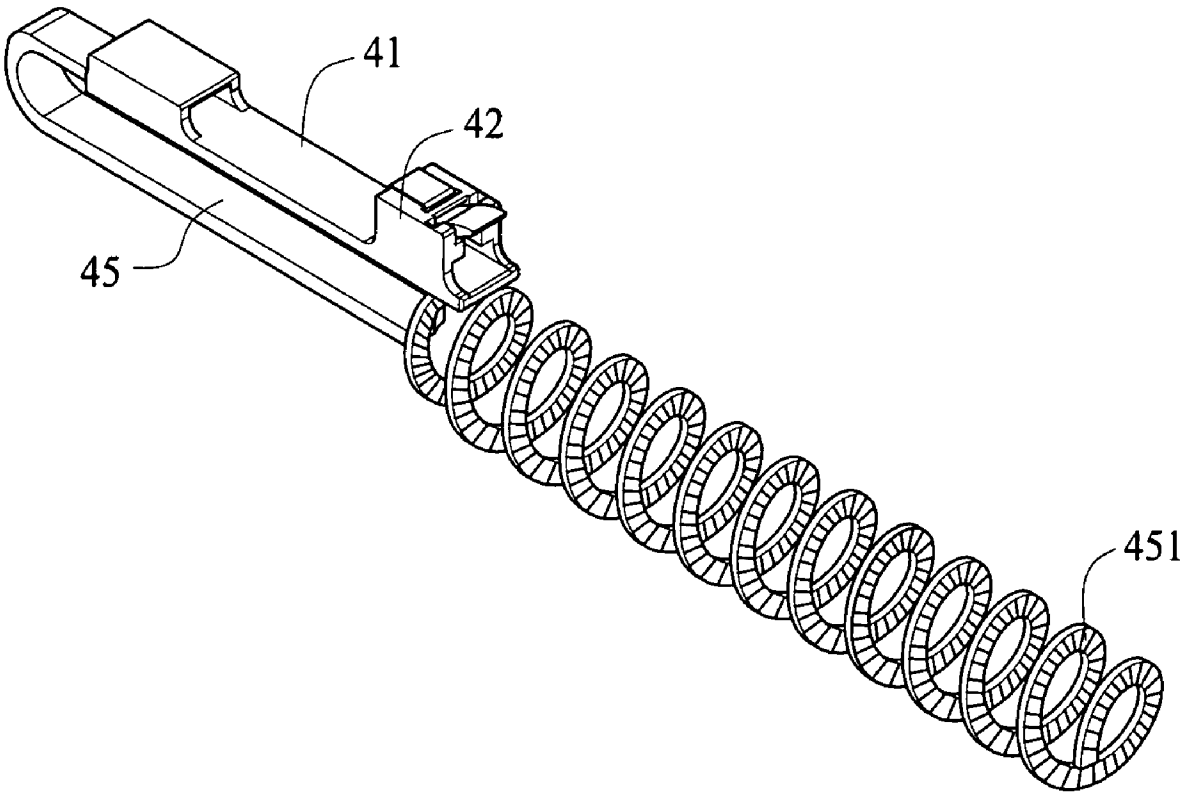
FIG. 21 is a three-dimensional view of a further implementation in accordance with a fourth preferred embodiment of the present invention.

With reference to FIG. 21 for a three-dimensionalview of a further implementation in accordance with a fourth preferred embodiment of the present invention, the third lace 45 includes an end having serrated groove 451 spirally curled like a telephone cord, and such curled end is unfavorable for sequentially passing the third lace 45 into the shoelace eyelet 31. After the first retaining base 42 and the third lace 45 are adjusted and tied with each other, a portion of the third lace 45 is dropped outside. Since the third lace 45 of this preferred embodiment comes with a spirally curled design, therefore the remaining length of the third lace 45 will be curled automatically to prevent the surplus length from touching the floor. In the fourth preferred embodiment, the first lace 41, the first retaining base 42 and the third lace 45 are integrally formed by a plastic injection molding, and thus they have the waterproof and stainproof features. In addition, the shoelace fastener of the present invention provides a simple and easy installation and operation, and it is definitely a functional and highly practical product.

In summation of the description of the aforementioned preferred embodiments as illustrated in FIGS. 1 to 21, the present invention has the following advantages:

1. The present invention includes the ratchets 13, 43, 151 and the elastic plates 14, 44, 152 in the first retaining bases 12, 42 or the second retaining base 15 for latching, clamping, fixing or passing the second lace 22, the shoelace 20 or the third lace 43, and thus the invention provides a convenient installation, and an easy and simple way of adjusting the shoelace.

2. Since the present invention can fit with generally used woven-cloth shoelace 20, thus lower the manufacturing and using costs.

3. The first retaining bases 12, 42 and the second retaining base 15 of the present invention are used together with the ratchets 13, 43, 151 and the elastic clipping elements 14, 44, 152, and thus the invention can enhance the structural strength and the durability for repeated uses of tying the shoelaces.

While the invention has been described by means of specific embodiments, other embodiments such as the shape, installation position of the first retaining base or the second retaining base or the length and width of the second lace can be altered as needed, and numerous other modifications and variations could be made thereto by those skilled in the art without departing from the scope and spirit of the invention set forth in the claims.

In summation of the description above, the present invention overcomes the shortcomings of the prior art and complies with patent application requirements, and thus is duly applied for patent application,

What is claimed is:

1. A shoelace fastener, for clamping and fastening a shoelace to maintain the tightness of the shoelace, comprising:

a first lace;

a first retaining base disposed at an end of the first lace, a containing space formed in the first retaining base, a pair of sidewall slots and at least one stop disposed at an end of the first retaining base, and a first insert hole formed at another end of the first retaining base;

a ratchet, including a pivoting portion pivotally installed into the pair of slots of the first retaining base, a second insert hole formed on the ratchet, and a catch portion disposed at an end of the ratchet, and another end of the ratchet being exposed from the first retaining base; and an elastic clipping element coupled to the first retaining base, the elastic clipping element having an ends inserted through the first insert hole to engage the second insert hole for coupling the ratchet and the first retaining base, such that when the shoelace is passed into the first retaining base, the elastic clipping element presses externally down on the catch portion of the ratchet to drive the ratchet to clamp and fix the shoelace.

2. The shoelace fastener of claim 1, further comprising a serrated structure disposed at an internal surface of the first retaining base and corresponding the catch portion of the ratchet.

3. The shoelace fastener of claim 1, wherein the first lace further includes a collar disposed at another end of the first lace.

4. The shoelace fastener of claim 3, further comprising a serrated structure disposed at an internal surface of the first retaining base and corresponding the catch portion of the ratchet.

5. The shoelace fastener of claim 1, wherein the first lace includes a second retaining base disposed at another end of the first lace, and the second retaining base includes a ratchet and an elastic plate disposed therein.

6. The shoelace fastener of claim 5, wherein the first lace and the first retaining base are integrally formed by a plastic injection molding.

7. A shoelace fastener of claim 1, wherein the first lace further includes a first fixing portion disposed at another end of the first lace.

8. A shoelace fastener of claim 7, wherein the first lace further includes a curved portion disposed at a connecting position of the another end of the first lace and the first fixing portion.

9. A shoe comprising:

a shoelace including two ends;

a first lace; and a first retaining base disposed on the first lace, and including:

a first base end having two sidewalls;

a second base end;

a containing space formed therein for passing therethrough at least one end of the shoelace;

a pair of slots;

at least a stop disposed on the two sidewalls of the first base end; and a first insert hole formed at the second base end;

a ratchet including a second insert hole, a pivoting portion pivotally installed into the pair of slots, and a catch portion for clamping and fixing the shoelace; and an elastic clipping element coupled to the first retaining base, the elastic clipping element having an end inserted through the first insert hole to engage the second insert hole for coupling the ratchet and the first retaining base, the elastic clipping element pressing externally down on the catch portion of the ratchet to drive the ratchet to clamp and fix the shoelace.

10. A shoe of claim 9, wherein the first lace further includes a first lace end and a second lace end, a collar disposed at the second lace end and a containing space passing therethrough the at least one end of the shoelace.

11. A shoe of claim 9, wherein the first lace includes a first lace end, a second lace end, a second retaining base disposed at the second lace end, wherein the first retaining base has an internal surface and includes a first serrated structure disposed at the internal surface of the first retaining base, and the second retaining base has an internal surface and includes a ratchet and an elastic clipping element disposed therein, and a second serrated structure disposed at the internal surface of the second retaining base.

12. A shoe of claim 9, wherein the elastic clipping element is a plastic C-shaped spring element.

13. A shoe comprising:

a first lace having two sidewalls;

a first retaining base disposed on the first lace, and including:

a first base end;

a second base end;

a containing space formed therein;

a pair of slots;

at least a stop disposed on the two sidewalls of the first base end; and a first insert hole formed at the second base end;

a ratchet including a second insert hole, a catch portion and a pivoting portion pivotally installed into the pair of slots; and an elastic clipping element coupled to the first retaining base, the elastic clipping element having an end inserted through the first insert hole to engage the second insert hole for coupling the ratchet and the first retaining base and thereby capture a shoelace passing through the first retaining base, the elastic clipping element pressing externally down on the ratchet; and a serrated groove portion disposed in the first retaining base to be latched by the catch portion of the ratchet.

14. A shoe of claim 13, wherein the first lace and the first retaining base are integrally formed by a plastic injection molding.

15. A shoe of claim 13, wherein the shoelace is formed by a plastic injection molding.

16. A shoe of claim 13, wherein the serrated groove is spirally curled and formed at an end of the shoelace.

17. A shoe of claim 13, wherein the first lace further includes a first lace end, a second lace end, and a collar disposed at the second lace end.

18. A shoe of claim 13, wherein the elastic clipping element is a C-shaped spring element.

19. A shoe of claim 18, wherein the first lace includes a first lace end, a second lace end, and a second retaining base disposed at the second lace end, and the second retaining base includes a ratchet and a C-shaped spring element disposed therein, and both the C-shaped spring elements of the first and the second retaining bases are made of plastic.

20. A shoe of claim 19, wherein the shoelace further includes another serrated groove and both of the serrated grooves are formed separately at both ends of the shoelace and to be latched by the ratchets of the first retaining base and the second retaining base.

* * * * *